United States Patent [19]

Gerhards

[11] Patent Number: 4,796,340

[45] Date of Patent: Jan. 10, 1989

[54] METHOD OF THREADING A YARN PROCESSING NOZZLE

[75] Inventor: Klaus Gerhards, Hückeswagen, Fed. Rep. of Germany

[73] Assignee: Barmag AG, Remscheid, Fed. Rep. of Germany

[21] Appl. No.: 921,363

[22] Filed: Oct. 20, 1986

[30] Foreign Application Priority Data

Oct. 19, 1985 [DE] Fed. Rep. of Germany ..... 3537321
May 10, 1986 [DE] Fed. Rep. of Germany ..... 3615829

[51] Int. Cl.[4] ..... D02G 1/12; D02G 1/16

[52] U.S. Cl. ..... 28/248; 28/255; 28/272; 28/249

[58] Field of Search ..... 28/255, 249, 272, 248

[56] References Cited

U.S. PATENT DOCUMENTS 3,854,177 12/1974 Breen et al. .
4,014,085 3/1977 Fink et al. ..... 28/255 X
4,280,260 7/1981 Martin et al. ..... 28/255
4,356,604 11/1982 Martin et al. ..... 28/255
4,416,041 11/1983 Gujer et al. ..... 28/255
4,453,298 6/1984 Nabulon et al. ..... 28/272 X
4,519,115 5/1985 Gujer et al. ..... 28/255
4,691,947 9/1987 Burkhardt et al. ..... 28/272 X

FOREIGN PATENT DOCUMENTS 0065726 5/1982 European Pat. Off. .
0189099 7/1986 European Pat. Off. ..... 28/272

*Primary Examiner*—Robert R. Mackey
*Attorney, Agent, or Firm*—Bell, Seltzer, Park & Gibson

[57] ABSTRACT

A yarn texturizing nozzle and method of thread-up of the nozzle are disclosed, and wherein the temperature of the nozzle remains substantially unchanged during yarn thread-up. The nozzle includes a body member having a yarn passageway extending therethrough, and the passageway is adapted to be laterally opened to permit the lateral insertion of the yarn during thread-up. Means are provided for supplying a heated treatment fluid such as air to the passageway, and control means are provided for maintaining the mass flow rate of the air substantially the same during yarn thread-up as when the passageway is closed during normal yarn processing.

9 Claims, 6 Drawing Sheets

METHOD OF THREADING A YARN PROCESSING NOZZLE

BACKGROUND OF THE INVENTION

The present invention relates to a yarn processing nozzle, such as a texturizing nozzle, and of the type wherein the yarn passageway is supplied with a heated gaseous or vaporous treatment fluid during operation, and which is adapted to be laterally opened to facilitate yarn thread-up. The present invention further relates to a method of threading a nozzle of the described type.

Yarn texturizing nozzles are used in the production of man-made filament yarns with the yarn operating at high spinning speeds of, for example, 2,000 m/min and above, and with the texturizing nozzle also serving to forwardly convey the advancing yarn. The thread-up of a nozzle of the described type presents a major problem, and it has been common to draw the yarns into the nozzle with a suction gun. This is a rather time consuming operation, and there have been numerous attempts to simplify this threading operation, note for example U.S. Pat. No. 4,519,115 and EPO Published Application 65726. All of these methods and devices involve the drawing of the yarn into the nozzle, and the disadvantages of such methods are well known.

Also known are nozzles which are divided in an axial plane of the yarn passageway, note for example U.S. Pat. No. 3,854,177, so that the advancing yarn can be inserted into the nozzle from the side, i.e. laterally with respect to its advancing direction. However, in the known apparatus of this type, the geometry of the yarn passageway and the air supply duct, and particularly the opening of the internal ducts, are so impaired that it is not possible to accomplish a satisfactory texturing of the yarn.

The present invention is based upon the nozzle designs described, for example, in copending U.S. applications Ser. Nos. 821,260 now U.S. Pat. No. 4,697,947, and 853,713 now U.S. Pat. No. 4,724,588. These designs have proven themselves to be excellent in operation, however a disadvantage has remained with these nozzles when they are opened to permit lateral threading of the yarns. In particular, when threading the yarn, a clearly increased quantity of the heated treatment fluid exits from the opened yarn passageway, as a result of the then reduced back pressure. This increased flow not only hinders the insertion of the yarn, but it also leads to a sharp decrease of the temperature of the nozzle and the heater of the treatment fluid. As a result, after closing the nozzle, it takes several minutes to restore stable operating conditions. The stopping of the supply of the treatment fluid will not solve this problem, since the heater would then have to shut down to prevent a risk of overheating and damage, and this also would lead to a delay after start-up before the nozzle reaches its operating temperature at stable conditions.

It will be understood that the heater for heating the treatment fluid has only a limited range of operation. One limit to the range of operation is the energy transfer capacity of the heater, i.e., the heater can only transfer a limited amount of heat to the treatment fluid. Thus, if there is a large mass of fluid flowing through the heater, the temperature of the fluid cannot be maintained. During the threading-up operation, the pressure of the fluid downstream of the heater will drop substantially, and therefore, the throughput of the heater will increase substantially to an extent exceeding the maximum heat transfer capacity of the heater. Thus, the temperature will drop. The disadvantage is that it will take time to again reach stable operating conditions after threading up. The other limit to the range of operation of the heater depends on the maximum temperature. Therefore, the heating system is provided with a control to switch off the energy supply, before a temperature is reached which will cause damage to the system. During normal operation, the heater operates within this range, and there is a temperature sensor provided to control energy supply in such a way that the fluid temperature remains constant and the operating conditions remain stable. The stable operating conditions, however, are disturbed by providing the lateral opening. The present invention renders it possible to maintain the stable operating conditions of the heater during the thread up operating in such a way that the heater is at least maintained within the range of operation as defined above.

It is accordingly an object of the present invention to provide a yarn treatment nozzle and a method of threading the same, which avoids the above noted disadvantages of the prior systems.

It is a more particular object of the present invention to provide a yarn treatment nozzle and method of threading the same in which the temperatures of the nozzle and in the heater, and the temperature of the treatment fluid leaving the heater, are maintained substantially at their operating level, while the nozzle is opened for thread-up.

It is a further object to maintain the heater in the control operation by which the temperature of the treatment fluid is maintained at the level of the treatment operation.

SUMMARY OF THE PRESENT INVENTION

These and other objects and advantages of the present invention are achieved in the embodiments described herein by the provision of a nozzle and method of the described type, and wherein the mass flow rate of the treatment fluid during yarn thread-up is maintained substantially at the level of the flow rate during the operation of the nozzle. This may be achieved by adapting the pressure to the reduced flow resistance resulting when the nozzle is opened. In this regard, a preferred treatment fluid is air or superheated vapor.

To more particularly summarize the present invention, there is provided a yarn processing nozzle which comprises a body member having a yarn passageway extending therethrough, and with the yarn passageway having a peripheral side wall. An internal duct is provided in the body member and which communicates with the yarn passageway, and means are provided for selectively either maintaining the peripheral side wall substantially closed during normal yarn processing, or providing a lateral opening through the side wall and along the entire length of the passageway to permit the lateral insertion of a yarn thereinto during yarn thread-up. Further, treatment fluid supply means is provided for supplying a pressurized and heated treatment fluid to the internal duct, and such that the treatment fluid enters the passageway. Control means are also provided which are operatively connected to the treatment fluid supply means, for maintaining the mass flow rate of the treatment fluid substantially the same when the lateral opening is provided in the side wall of the passageway during yarn thread-up, as when the side wall is substantially closed during normal yarn processing.

In one embodiment of the invention, the pressure upstream of the heater in the treatment fluid supply means is adjusted and decreased when the nozzle is opened, such that the mass flow of fluid through the heater is maintained at the same level as during operation. For example, the pressure at the heater may be reduced to a value which is less than about 0.5 bar, when air is the treatment fluid. Advantageously, the pressure may in this example be in the range between about 0.15 to 0.45 bar.

In another embodiment of the invention, the stabilization of the mass flow rate of the treatment fluid is accomplished by adjusting when the yarn is threaded, the pressure upstream of the heater in dependence upon the temperature of the treatment fluid as measured in or closely downstream of the heater, by the use of controlling or regulating means, and so that the temperature is maintained substantially at its operating level. The mass flow rate in the context of the present invention is understood to mean the weight of the treatment fluid carried per unit of time.

There are several other embodiments of an apparatus according to the present invention, and which are suitable for carrying out the method of the present invention. Thus in one further embodiment, a texturizing nozzle is provided which is adapted for opening, and wherein the connection with the treatment fluid includes two separate sources, each supplying a treatment fluid at a different pressure. More particularly, one of the sources may supply the fluid at the operating pressure, and the other supplies the fluid at a reduced pressure which is required during yarn thread-up. Alternatively, the treatment fluid may be supplied through a single main line, having a bypass extending parallel to the main line and which contains a throttling or pressure reducing valve. Also, a shut-off valve is provided in the main line between the bypass junctions, making it possible to supply the nozzle only via the bypass line and thus with a reduced pressure. Preferably, the bypass line always remains open.

Another advantageous embodiment of the present invention includes a controlling or regulating device, which so controls the pressure regulating device positioned upstream of the heater as a function of the temperature taken at the heater outlet, that the temperature of treatment fluid leaving the heater remains practically constant. This device can be used when either hot air or hot vapor serves as the treatment fluid, since in the generation of the vapor, the vapor must be superheated directly adjacent the nozzle.

In still another embodiment of the present invention, the device for opening the yarn passageway of the nozzle for threading a yarn, may be coupled via electric, electromagnetic, pneumatic, hydraulic, or hybrid means, with the device for regulating the pressure upstream of the heater, thereby making it possible to essentially synchronize the changeover of the pressure with the opening and closing of the yarn passageway.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
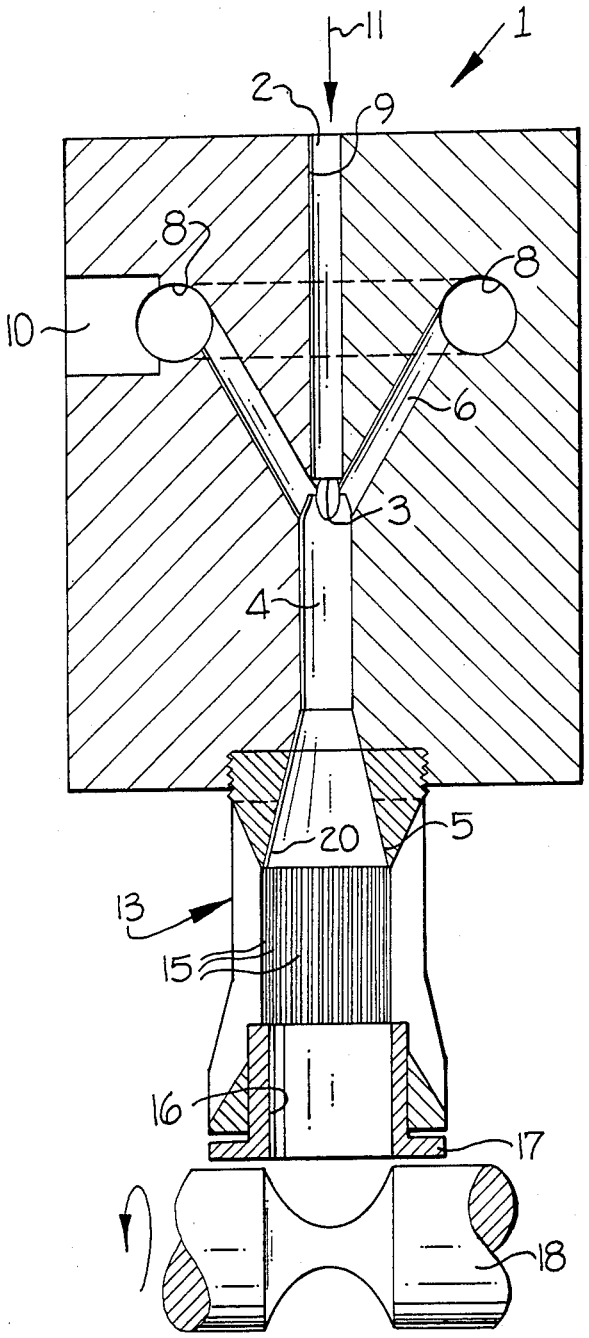
FIG. 1 is a sectional plan view of a yarn texturing nozzle which embodies the present invention.

Referring more particularly to the drawings, FIG. 1 illustrates a nozzle 1 which embodies the present invention, and which includes a yarn passageway 2, through which a yarn (not shown) advances in the direction 11. The yarn passageway 2 widens at a shoulder 3, at which the relatively narrow entry portion of the yarn passageway changes to a relatively wide portion 4, which is followed by a tapered outlet 5 serving as a diffuser, and which leads to a stuffer box 13 where a yarn tangle is formed.

At the shoulder 3, four fluid delivery internal ducts 6 open into the yarn passageway. The ducts 6 each extend between four bores 8 which form an annular internal conduit which surrounds the yarn passageway when viewed in a plane perpendicular to the yarn passageway. Specifically, the bores 8 form a polygon which surrounds the yarn passageway, note the upper portion of FIG. 2. A supply duct 10 connects the annular conduit to a source of pressurized and heated treatment fluid such as hot air or saturated steam. Also, the nozzle 1 is in the form of a divisible block (note FIG. 2), which is divided along a plane 9 to permit the passageway 2, 4 to be opened and thereby facilitate yarn thread-up.

The stuffer box 13 is designed as a slotted tube and has in its upstream or central portions of the side wall of the tube longitudinal slots 15 or perforations distributed over its circumference, through which the treatment fluid can exhaust. In the exit area, the slots 15 are covered by an annular sleeve 16 with a flange-shaped stop 17, which prevents the filaments of the yarn plug from adhering to the walls of the slotted tube. A pair of profiled rolls 18 of the feed mechanism is provided downstream of the stuffer box for withdrawing the yarn plug formed in the box, with the two rolls being located in a plane which is normal to the axis of the stuffer box and such that the grooves in the rolls form an axial passage for the yarn plug leaving the stuffer box.

The stuffer box 13 has a yarn insertion slot 20 cut through the side wall and which extends over the entire length of the stuffer box, including the sleeve 16. The yarn insertion slot 20 as well as the axis of the stuffer box are preferably arranged in such a way that they lie in the separating plane 9 of the nozzle block. The alignment of the yarn inserting slot 20 in the stuffer box with the separating plane 9 thus serves to facilitate the threading of the yarn into the stuffer box.

Figure 2:
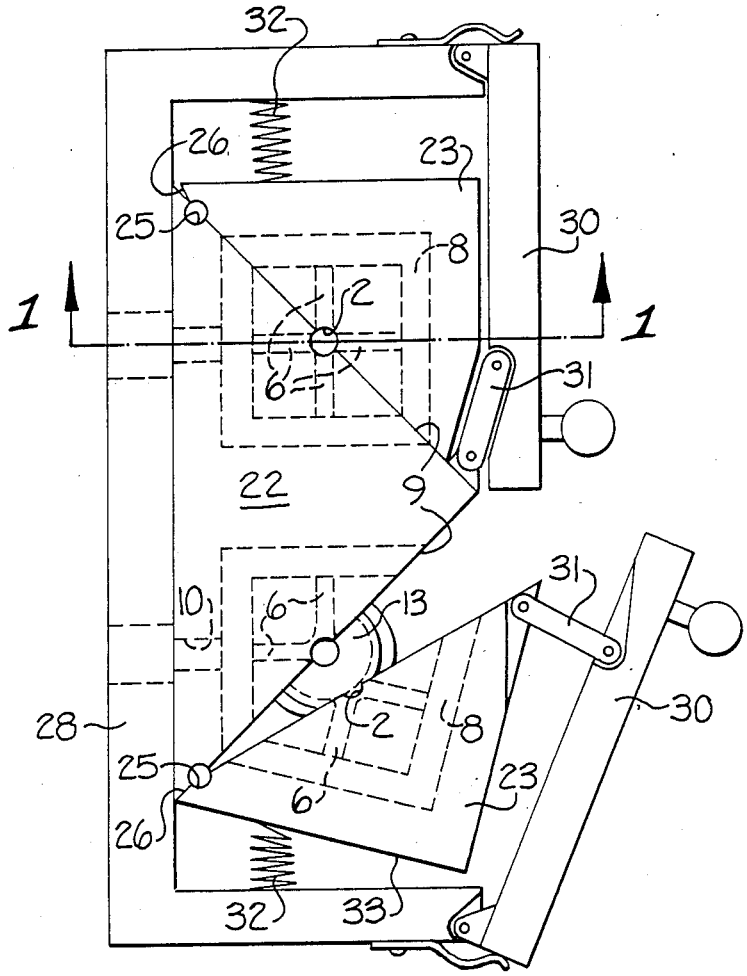
FIG. 2 is a side elevation view of an embodiment of the present invention comprising two nozzles of the type shown in FIG. 1.

FIG. 2 illustrates an embodiment which comprises a divisible double nozzle for advancing and texturizing two yarns. The lower nozzle is shown in an opened or thread-up position, and the upper nozzle is shown in a closed or operative position. The double nozzle is made of a block which is rectangular in cross section, and as illustrated, measures twice as long as wide. The block is divided along two mutually perpendicular planes 9 which extend coaxially along respective ones of the two passageways. Resulting therefrom is a central block part 22 in the form of a right angled isosceles triangle in cross section. The two external or outer nozzle parts 23 are likewise a right angled, isosceles triangle in cross section. Formed into the two nozzle parts 22, 23 by, for example drilling, are yarn passageways as well as a hinge bore 25, which forms cylindrical groove halves in each contact surface. The bore 25 receives a rod so as to form a hinged connection. At least one of the edges of the separating surfaces located at hinge bore 25 has a slightly beveled edge or chamfer 26 so that the outer part 23 can be pivotally opened a corresponding angle.

Two of the bores 8 are formed in each of the outer nozzle parts 23 and the central nozzle part 22, with the bores 8 positioned each on opposite sides of the yarn passageway 2, and lying in a plane perpendicular to the yarn passageway. Each bore 8 forms an acute angle with the separating plane of 45° so that the internal ends of the bores meet. These bores form the annular internal conduit for each of the nozzles, and which surrounds the yarn passageway 2 in the manner described above.

The double nozzle is surrounded by an insulating jacket 28, which is preferably heated and provided with a door 30 on the front side of each nozzle. A closing lever 31 connects each door 30 with its respective outer nozzle part 23, so that each nozzle may be opened and closed simultaneously with the door of the insulating jacket. Springs 32 support the outer nozzle parts 23 between the insulating jacket and their outside surface 33. Two advancing yarns can thus be inserted laterally with respect to their direction of advance into each yarn passageway without having to be cut or drawn in by suction, and with the yarns being separated by the central nozzle part 22.

As will be apparent, after opening the nozzle 1, the openings of the annular ducts 8 terminating in the contact surfaces are exposed, so that the treatment fluid can freely flow out. This results in a considerable impediment to the yarn insertion by reason of the large quantity of exiting fluid. Further, there is a considerable decrease of the temperature in the heater. In accordance with the present invention, means are provided to limit the mass flow rate of the treatment fluid during such opening of the nozzle to a value which corresponds substantially to that occuring during the normal texturizing operation.

Figure 3:
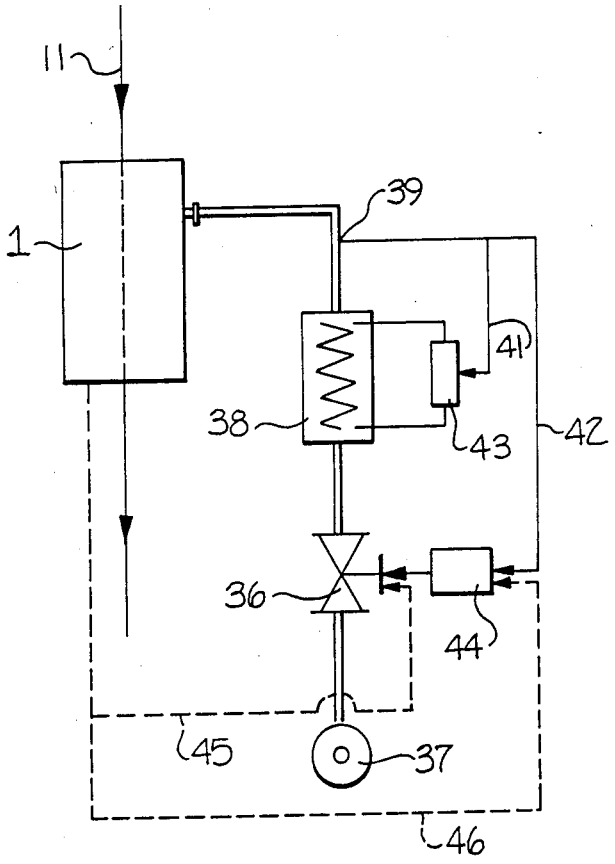
FIG. 3 is a schematic view illustrating the treatment fluid supply means and control means in accordance with the present invention.

FIG. 3 schematically illustrates one embodiment for limiting the exiting quantity of the treatment fluid to the desired value. To this end, an adjustable pressure reducing or throttle valve 36 is positioned between the source 37 of the fluid (e.g. air) and the heater 38. The temperature sensor 39 monitors the air temperature between the heater 38 and the nozzle 1, and transmits the measured signal via the lines 41 and/or 42 to the controlling or regulating units 43, 44, respectively. The unit 43 serves to control the heating energy supply of the heater 38, and the unit 44 serves to influence the degree of opening of the throttle valve 36. Furthermore, automatic control by unit 44 may be set into effect by activating unit 44 by hand or automatically as indicated by line 46 if nozzle 1 is opened.

The embodiment of FIG. 3 also permits other different possibilities of operation. Thus, the pressure reducing throttle valve 36 may be adjusted by hand upon the nozzle 1 being opened for threading. Alternatively, automatic control may be provided by coupling the nozzle 1 to the valve 36 in a known mechanical or electrical manner, as indicated schematically by the line 45. Thus the valve may be automatically set at a position where minimal air pressure is supplied during yarn thread-up. The adaptation between the texturizing operation and the yarn thread-up operation can be improved by keeping the heating energy supply circuit in operation not only during treating but also during threading of the yarn. To this effect the temperature signal reaching the regulating or controlling unit 43 influences the energy supplied to the heater. This allows an adjustment for minor temperature fluctuations which are caused by slight deviations of the mass flow rate from the targeted value. The measured value signalled by the temperature sensor is at the same time used to control the quantity of the mass flow rate with the assistance of the controlling or regulating unit 44 and the valve 36. Assuming that the energy supply remains uniform, it can be accomplished that the mass flow rate will remain substantially the same even when the conditions of the fluid supplied to the heater from the source 37 are subject to fluctuations. The circuit diagram of FIG. 3 also makes it possible to mutually supplement the influence of the heater 38 via the unit 43, and the control of the pressure reducing valve 36 via the unit 44, so as to reach a constant heater temperature at a substantially constant mass flow rate.

Figure 4:
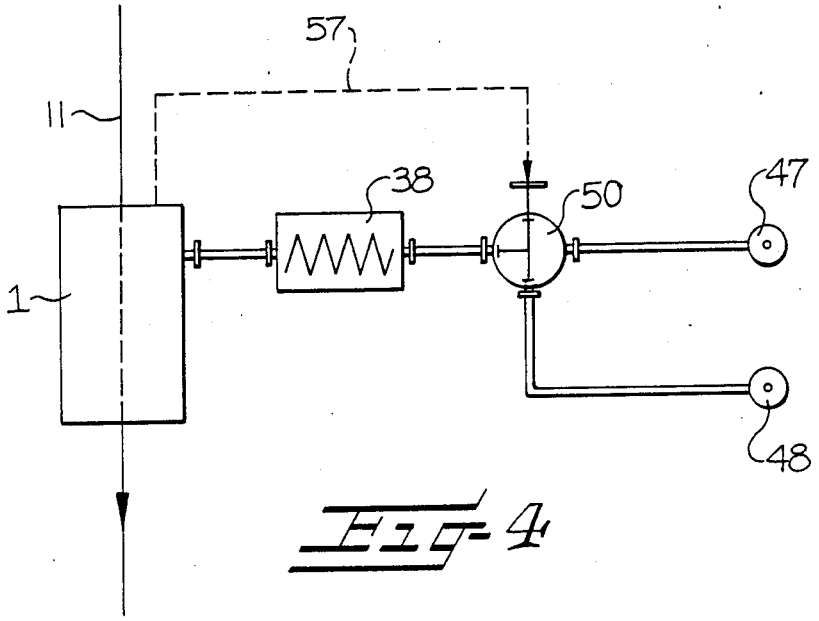
FIGS. 4 and 5 are similar to FIG. 3, and illustrating other embodiments of the treatment fluid supply means and control means.

FIG. 4 illustrates a particularly simple embodiment of the present invention. In this embodiment, two separate air sources 47 and 48 are provided for supplying air to the texturizing nozzle 1 via the heater 38. The source 47 supplies air at a relatively high pressure of, for example, 4–8 bar which is required for texturing, whereas the source 48 supplies air at a relatively low pressure, for example, at a maximum of 0.5 bar and which is required for maintaining the air flow rate constant during yarn thread-up. The change from one source of air to the other is effected in a simple manner with the aid of a three way valve 50, which is adjusted by hand to the illustrated position at the beginning of the thread-up operation. Alternatively, the valve 50 may be coupled to the nozzle 1 as indicated schematically by the line 51 so that the valve is automatically coupled with the opening and closing of the nozzle 1. The reversal to the source of air 47 is effected by rotating the valve 50 relative to the illustrated position clockwise by 90° thereby simultaneously shutting off the connection with the source of air 48.

The pressure of the air supplied by the source 48 should not exceed 0.5 bar, if possible. Advantageously, a value ranging from 0.15 to 0.45 bar is selected, it being understood that the optimal value will be empirically determined. Also, this embodiment permits the control of the air heater via items 39, 41, 43, as shown and described with respect to FIG. 3.

Figure 5:
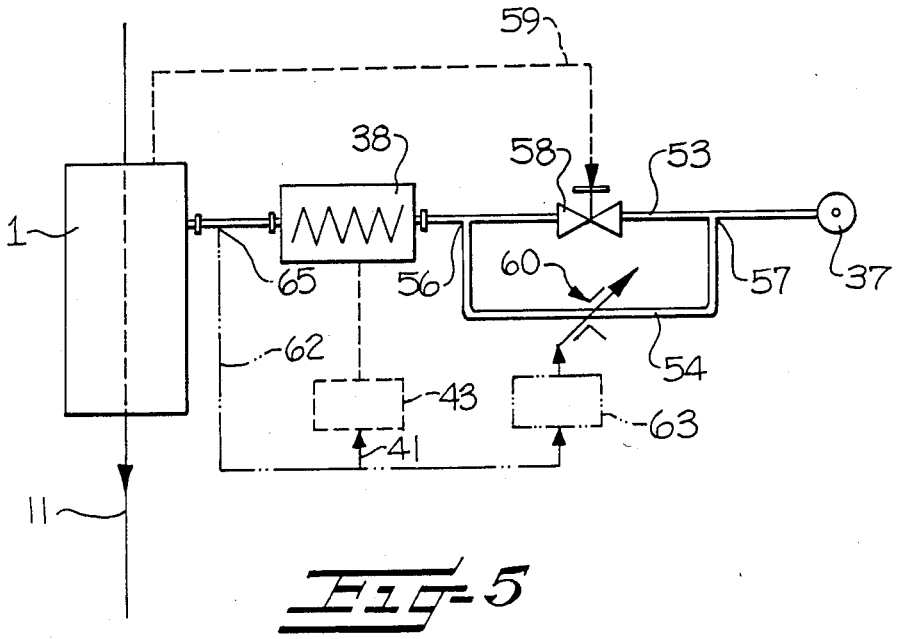

FIG. 5 illustrates still another advantageous embodiment. This embodiment includes a single main supply line 53, and the reduced air pressure for thread-up is supplied through a bypass line 54 which extends parallel to the main line 53. Provided between the junctions 56 and 57 of the bypass line 54 is a shut-off valve 58, which can be of relatively simple design, such as a stopcock with a plug rotatable between an opened and a closed position. The shut-off valve may be adjusted manually, or it may be coupled so as to be automatically controlled as indicated schematically by line 59 with the opening and closing of the nozzle 1.

The bypass 54 which supplies the air during the yarn thread-up, remains permanently connected with the main line 53. An adjustable throttle valve 60, which may alternatively take the form of a pressure reducing valve, serves to provide the necessary reduction of the air pressure. The throttle 60 is adjusted to an empirically determined cross section of the throttle, and the closing of the shutoff valve provides that only a reduced pressure is delivered to the air heater via the bypass 54, so that a constant mass flow rate of the air is ensured.

As also indicated in dash-dot line 62 in FIG. 5, the cross section of the throttle in the bypass 54 may be controlled by a regulating unit 63 as a function of the measured values which are provided through the line 62 by a temperature sensor 65. This arrangement ensures that a highly consistent mass flow rate is maintained. The energy supplied to the heater 38 may also be controlled by the line 41 and regulating unit 43 as described above.

Figure 6:
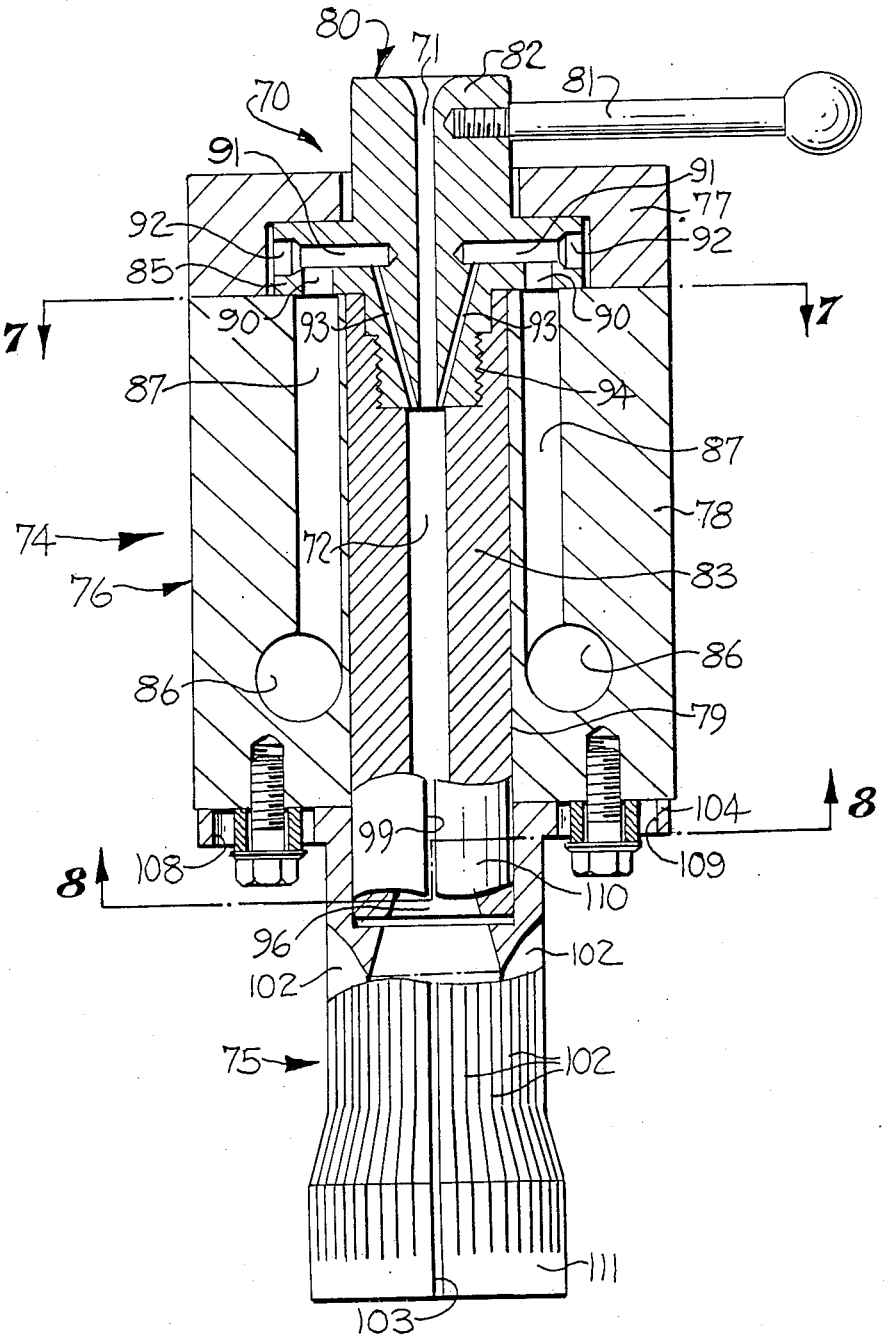
FIG. 6 is a sectional side elevation view of a further embodiment of a nozzle in accordance with the present invention.

FIG. 6 illustrates at 70 a further embodiment of a texturing nozzle in accordance with the present invention, and which includes provision for opening the yarn passageway 71, 72 during yarn thread-up. The texturing nozzle comprises a yarn feeding inlet portion 74 and a stuffer box 75. The inlet portion 74 comprises a casing 76 in the form of a rectangular solid, and which is composed of an upper block 77 and a lower block 78 which are interconnected to each other. The casing also includes a cylindrical bore 79 extending therethrough and defining an inlet or upper end as seen in FIG. 6, and an opposite or lower outlet end. The inlet portion of the bore 79 mounts a guide cylinder 80 which is rotatably received within the bore, and which extends longitudinally through the entire axial length of the bore. The guide cylinder 80 is adapted to be rotated about the axis of the bore by means of an adjusting lever 81.

The guide cylinder 80 is composed of two components, an upper component 82 and a lower component 83. The upper component 82 includes an annular shoulder 85 which rests upon the upper surface of the casing lower block 78. A distributor duct 86 extends within the block 78 on three sides of the bore 79, and is connected with a source of heated and pressurized air or vapor in the manner described above. Several delivery channels 87 proceed axially from the duct 86, and extend in the casing block in a direction parallel to the bore 79. The delivery channels 87 terminate on the upper surface of the block. The distributor duct 86 and delivery channels 87 are made to extend along substantially the entire length of the block 78, so that they effect a heating thereof.

The bottom side of the annular shoulder 85 and which faces the upper surface of the casing block 78, includes an annular groove 90 which mates with the outlet ends of the delivery channels 87. Four radial connecting ducts 91 extend from the outer periphery of the annular shoulder 85 into the upper component 82 of the guide cylinder 80. The ducts 91 are thus connected with the annular groove 90, and are closed on their outer periphery of the annular shoulder 85 by threaded plugs 92. An internal duct 93 proceeds from the inner end of each connecting duct 91, and leads to the lower end surface of the upper component 82, and so as to be directed into the passageway 72 of the lower component of the guide cylinder. Since there are four connecting ducts 91 in the upper component 82, there are associated four internal ducts 93 which extend along the imaginary surface of an acute angled cone. The lower end of the upper component 82 includes a threaded male end portion at 94, and the lower component 83 of the guide cylinder includes a female receptacle into which the end portion of the upper component 82 is threaded. The upper block 77 of the casing forms a cover which is firmly bolted to lower block 78, and which includes an annular shoulder for securing the guide cylinder 80 in position.

The casing 76 includes a thread-up slot 98 (note FIG. 7A) extending axially along its length and laterally between the bore 79 and the outer periphery of the casing. Also, the guide cylinder 80 has a thread-up slot 99 extending axially along its length and laterally between the yarn passageway 71, 72 and the outer periphery of the guide cylinder.

Figure 8A:
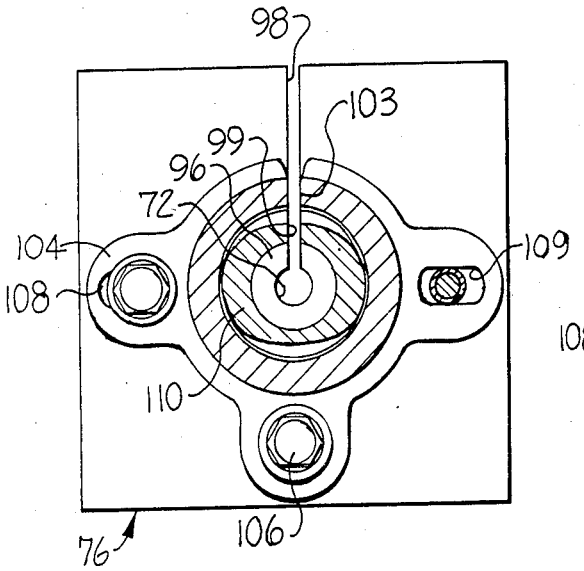
FIGS. 8A and 8B are sectional plan views taken substantially along the line 8—8 of FIG. 6, and illustrating the thread-up position and the operating position respectively.

The passageway 72, which may be termed a mixing channel, terminates in a diffuser 96, and leads into a stuffer box 75. The stuffer box is a relatively thin tube, which contains longitudinal slots 102 over a portion of its length. The longitudinal slots may be cut by a side milling cutter, and they serve the purpose of permitting the hot gas or vapor to escape from the stuffer box. The box is also provided with a threading slot 103, which extends over the entire length of the stuffer box, and is in alignment with the threading slot 98 in the casing 76. The stuffer box also includes a flange 104, by which the box is mounted to the casing block 78 by means of a bolt 106 which is positioned on the side of the block 78 which is opposite to the threading slot 103. The flange 104 also includes oblong openings 108 and 109, located 90° from the bolt 106 as best seen in FIG. 8A. By this arrangement, the flange is mounted to the casing block 78 so that the wall of the stuffer box 75 can perform limited radial movement for the purpose of opening and closing the threading slot 103. The guide cylinder has an end portion 110 which extends into a receptacle in upper end of the stuffer box 100, and both the end portion 110 and the receptacle of the stuffer box have an oval cross section, with the two cross sections being of similar outline. Also, the stuffer box is manufactured so that it is internally biased so as to tend to naturally close the slot 103, which may be provided for example by surrounding it with a spring ring at 111.

Figure 7A:
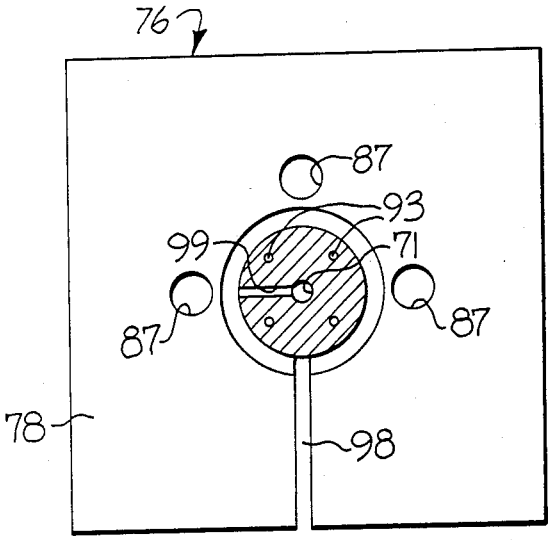
FIG. 7A is a sectional plan view taken substantially along the line 7—7 of FIG. 6, and illustrating the nozzle in its operating position.

As illustrated in FIG. 7A, which is the operating position of the guide cylinder 80, the threading slot 99 of the guide cylinder is non-aligned with the threading slot 98 of the casing 76 and with the threading slot 103 of the stuffer box 100. In this operating position, the primary axes of the oval end portion 110 and of the oval receptacle of stuffer box 100 are aligned. As a result, the threading slot 103 of the stuffer box is closed by reason of the internal bias of the stuffer box.

Figure 7B:
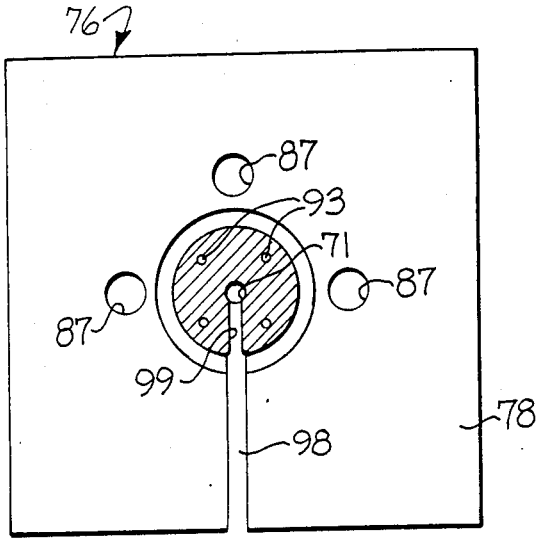
FIG. 7B is a view similar to FIG. 7A but illustrating the nozzle in its thread-up position.

FIG. 7B illustrates the threading position, and wherein all of the slots 98, 99, and 103 are in alignment. By rotating the guide cylinder 80, the primary axis of the oval end portion 110 will lie along the small secondary axis of the oval receptacle of the stuffer box 75. As a result, the stuffer box is spread open in the area of its threading slot 103.

Figure 8B:
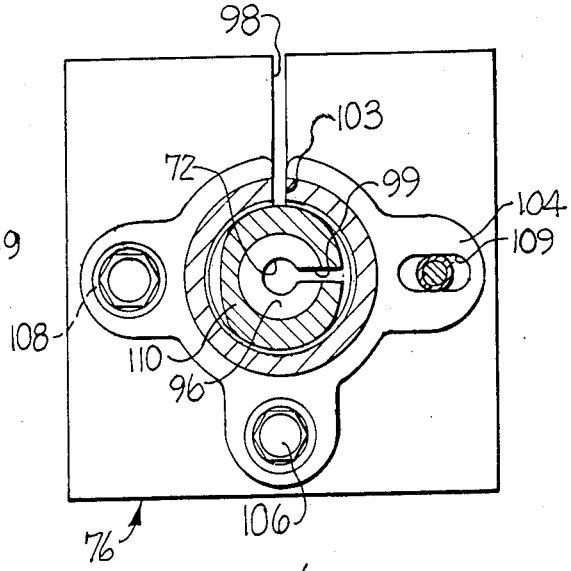

As illustrated in FIG. 8B, which is the operating position of the guide cylinder 80, the threading slot 99 of the guide cylinder is non-aligned with the threading slot 98 of the casing block 78 and with the threading slot 103 of the stuffer box 75. In this operating position, the primary axes of the oval end piece 110 and of the oval receptacle of stuffer box 75 are aligned. As a result, the threading slot 103 of the stuffer box is closed by reason of the internal bias of the stuffer box.

FIG. 8A illustrates the threading position, and wherein all of the slots 98,99, and 103 are in alignment. By rotating the guide cylinder 80, the primary axis of the oval end piece 110 will lie along the small secondary axis of the oval receptacle of the stuffer box. As a result, the stuffer box is spread open in the area of its threading slot 103.

From the above description, it will be seen that an important advantage of the present invention resides in the fact that during yarn thread-up, the supply of the heated treatment fluid is not discontinued, but is reduced so that the amount of heat supplied by the heater remains substantially constant. Stated in other words, the amount of the delivered heat remains the same and the temperature of the heated treatment fluid does not leave its regulated range when the capacity of the heater is reduced. As a result, the heater and the nozzle remain at the operating temperature, even during the yarn thread-up, and upon completion of the thread-up operation, the nozzle will be ready for immediate production.

In the drawings and specification, there have been disclosed typical preferred embodiments of the invention and, although specific terms are employed, they are used in a generic and descriptive sense only and not for purposes of limitation, the scope of the invention being set forth in the following claims.

That which I claim is:

1. A method of threading a yarn through a yarn processing nozzle of the type comprising a body member having a yarn passageway extending therethrough, with said yarn passageway having a peripheral side wall, an internal duct in said body member and communicating with said passageway, means for selectively maintaining the peripheral side wall either substantially closed during normal yarn processing or laterally open along the entire length of said passageway to permit the lateral insertion of a yarn thereinto during yarn thread-up, and treatment fluid supply means including heating means for supplying a pressurized and heated treatment fluid to said internal duct and such that the treatment fluid enters said passageway, and comprising the steps of maintaining the peripheral side wall substantially closed and while supplying a treatment fluid to said internal duct and said passageway, with the treatment fluid having a predetermined operating mass flow rate and a predetermined operating temperature, laterally opening the peripheral side wall of said passageway to thereby reduce the flow resistance of the nozzle to said treatment fluid;

laterally inserting a yarn into the laterally open passageway, and then laterally closing the peripheral side wall of said passageway, and maintaining the mass flow rate and temperature of said treatment fluid substantially at said predetermined operating mass flow rate and predetermined operating temperature during all of the above steps.

2. The method as defined in claim 1 wherein said maintaining step includes restricting the mass flow rate through said treatment fluid supply means while said peripheral side wall of said passageway is open.

3. The method as defined in claim 1 wherein said treatment fluid supply means comprises a source of pressurized treatment fluid, a line leading from the source to said internal duct, with said heating means operatively connected to said line, and wherein said step of maintaining the mass flow rate while the peripheral side wall of said passageway is open includes sensing the temperature in said line downstream of said heating means, and throttling the fluid flow at a point upstream of the heating means in response to the sensed temperature and so that the output of the heating means and the degree of throttling is adjusted and such that the mass flow rate and temperature of the treatment fluid remain substantially constant in the event of changes in the temperature or pressure of the supplied treatment fluid.

4. The method as defined in claim 3 wherein the fluid flow is throttled in response to a pressure drop of said treatment fluid downstream of said heater.

5. The method as defined in claim 3 wherein the fluid flow is throttled in response to the lateral opening being provided in the peripheral side wall.

6. The method as defined in claim 1 wherein said treatment fluid supply means comprises a first source of treatment fluid at a relatively high pressure, and a second source of treatment fluid at a relatively low pressure, and wherein the step of maintaining the mass flow rate includes operatively connecting the first of said sources to said internal duct while the peripheral side wall is maintained substantially closed, and operatively connecting the second of said sources to said internal duct when said side wall is laterally opened.

7. The method as defined in claim 1 wherein said treatment fluid supply means comprises a single source of treatment fluid, a main line extending from said source to said internal duct, shut-off valve means in said main line, and a bypass line bypassing said shut off valve means, and wherein the step of maintaining the mass flow rate while the peripheral side wall of said passageway is open includes closing said shut-off valve and throttling said bypass line.

8. The method as defined in claim 7 wherein said heating means is operatively connected to said main line downstream of said bypass line, and said step of maintaining the mass flow rate while the peripheral side wall of said passageway is open further includes sensing the temperature of the treatment fluid in said main line at a location downstream of said heating means, and adjusting the throttling of said bypass valve in response to the sensed temperature.

9. The method as defined in claim 1 wherein said treatment fluid is selected from the group consisting of air and superheated vapor.

* * * * *